US008584383B1

(12) United States Patent
Morse et al.

(10) Patent No.: US 8,584,383 B1
(45) Date of Patent: Nov. 19, 2013

(54) CASTER WHEEL ASSEMBLY FOR A SNOWBLOWER

(71) Applicants: Lanny E. Morse, Lincoln, KS (US); Royce E. Sperry, Blair, NE (US)

(72) Inventors: Lanny E. Morse, Lincoln, KS (US); Royce E. Sperry, Blair, NE (US)

( * ) Notice: Subject to any disclaimer, the term of this patent is extended or adjusted under 35 U.S.C. 154(b) by 96 days.

(21) Appl. No.: 13/623,928

(22) Filed: Sep. 21, 2012

(51) Int. Cl.
*E01H 5/09* (2006.01)

(52) U.S. Cl.
USPC ..... 37/244; 37/242

(58) Field of Classification Search
USPC ..... 37/242, 244, 249, 221, 223
See application file for complete search history.

(56) References Cited

U.S. PATENT DOCUMENTS

| | | | | |
|---|---|---|---|---|
| 3,320,688 | A * | 5/1967 | Haban et al. | 37/242 |
| 3,490,057 | A * | 1/1970 | Kahlbacher | 37/245 |
| 4,441,266 | A * | 4/1984 | Westimayer | 37/244 |
| 4,852,279 | A * | 8/1989 | Gerbrandt | 37/252 |
| 5,101,585 | A * | 4/1992 | Gerbrandt | 37/252 |
| 5,410,824 | A * | 5/1995 | Pedersen | 37/242 |
| 6,508,018 | B1 * | 1/2003 | O'Brien | 37/223 |
| 7,051,461 | B2 * | 5/2006 | Itou et al. | 37/219 |
| 7,059,071 | B2 * | 6/2006 | Hanafusa et al. | 37/249 |
| 7,137,214 | B2 * | 11/2006 | Hoerle et al. | 37/242 |
| 7,984,573 | B2 | 7/2011 | Lau | |
| D657,395 | S * | 4/2012 | Bauer et al. | D15/11 |
| 8,191,289 | B2 * | 6/2012 | Raftery | 37/271 |
| 2005/0039353 | A1 * | 2/2005 | Hanafusa et al. | 37/242 |
| 2005/0066553 | A1 | 3/2005 | Light | |
| 2006/0070265 | A1 * | 4/2006 | Cohen | 37/246 |
| 2006/0150444 | A1 * | 7/2006 | Friberg et al. | 37/244 |
| 2010/0236106 | A1 * | 9/2010 | Muscarella | 37/196 |

* cited by examiner

*Primary Examiner* — Thomas B Will
*Assistant Examiner* — Joan D Misa
(74) *Attorney, Agent, or Firm* — Dennis L. Thomte; Thomte Patent Law Office LLC

(57) ABSTRACT

A caster wheel assembly is disclosed for a snowblower wherein a pair of caster wheel assemblies are secured to the opposite sides of the auger housing of the snowblower in a manner wherein the caster wheels thereof are positioned inwardly of the sides of the auger housing and are positioned rearwardly of the rearward end of the auger housing.

3 Claims, 2 Drawing Sheets

CASTER WHEEL ASSEMBLY FOR A SNOWBLOWER

CROSS-REFERENCE TO RELATED APPLICATION

This is a non-provisional application based upon Provisional Application Ser. No. 61/553,514, filed Oct. 31, 2011, entitled A CASTER WHEEL ASSEMBLY FOR A SNOWBLOWER.

BACKGROUND OF THE INVENTION

1. Field of the Invention

This invention relates to a snowblower and more particularly to a caster wheel assembly which is secured to each of the side walls of the auger housing of the snowblower. The caster wheels of the caster wheel assemblies are positioned rearwardly of the auger housing and are positioned inwardly of the side walls of the auger housing.

2. Description of the Related Art

Conventional walk-behind snowblowers include a wheeled frame means having an auger housing at the forward end thereof with the auger housing having an open forward end, a rearward end, a first side wall and a second side wall with the side walls having forward and rearward ends. In the conventional walk-behind snowblowers, a skid shoe is secured to the lower ends of the first and second side walls so that the scraper bar of the auger housing is suspended just slightly above the surface being cleared. The conventional skid shoes are selectively vertically adjustably secured to the side walls of the auger housing so that as the scraper bar wears, the skid shoes may be vertically adjusted. Although the conventional skid shoes of the walk-behind snowblowers do perform fairly satisfactorily, the skid shoes are in constant contact with the surface being cleared which creates a significant drag to the forward or rearward movement of the snowblower. Even more importantly, when the snowblower is pivoted or turned, the drag of the skid shoes makes the turning of the same difficult unless downward pressure is applied to the handle of the snowblower to raise the scraper bar and the skid shoes out of contact with the surface being cleared.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

A caster wheel assembly is provided for a snowblower with the snowblower being adapted to remove snow from a surface. The snowblower includes an auger housing having a first upstanding side wall with forward and rearward ends and inner and outer sides and a second side wall with forward and rearward ends and inner and outer sides. A scraper blade extends between the first and second side walls at the lower forward ends thereof.

A first vertically disposed support having forward and rearward ends and inner and outer sides is provided. The first support has its forward end selectively vertically adjustably secured to the outer side of the first side wall of the auger housing forwardly of the rearward end thereof so that the rearward end of the first support is positioned rearwardly of the rearward end of the first side wall of the auger housing. A first caster wheel is adjustably secured to the inner side of the first support adjacent the rearward end thereof so as to be positioned rearwardly of the auger housing.

A second support, having rearward and forward ends and inner and outer sides is also provided. The second support has its forward end selectively vertically adjustably secured to the outer side of the second side wall of the auger housing forwardly of the rearward end of thereof so that the rearward end of the second support is positioned rearwardly of the rearward end of the second side wall of the auger housing. A second caster wheel is adjustably secured to the inner side of the second support adjacent the rearward end thereof so as to be positioned rearwardly of the auger housing.

In a further embodiment of the invention, an elongated stabilizing member, having first and second ends, is secured to the rearward ends of the first and second supports and extends therebetween.

It is therefore a principal object of the invention to provide a caster wheel assembly for a snowblower.

A further object of the invention is to provide a caster wheel assembly for a snowblower which replaces the skid shoes of the snowblower.

A further object of the invention is to provide a caster wheel assembly for a snowblower which enables the snowblower to move more easily over the surface to be cleared and which enables the snowblower to be more easily maneuvered.

A further object of the invention is to provide a caster wheel assembly for a snowblower which is selectively vertically adjustably secured to the side walls of the snowblower and wherein the caster wheel assemblies are selectively horizontally adjustably secured to their respective supports.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Embodiments are described more fully below with reference to the accompanying figures, which form a part hereof and show, by way of illustration, specific exemplary embodiments. These embodiments are disclosed in sufficient detail to enable those skilled in the art to practice the invention. However. embodiments may be implemented in many different forms and should not be construed as being limited to the embodiments set forth herein. The following detailed description is, therefore, not to be taken in a limiting sense in that the scope of the present invention is defined only by the appended claims.

Figure 1:
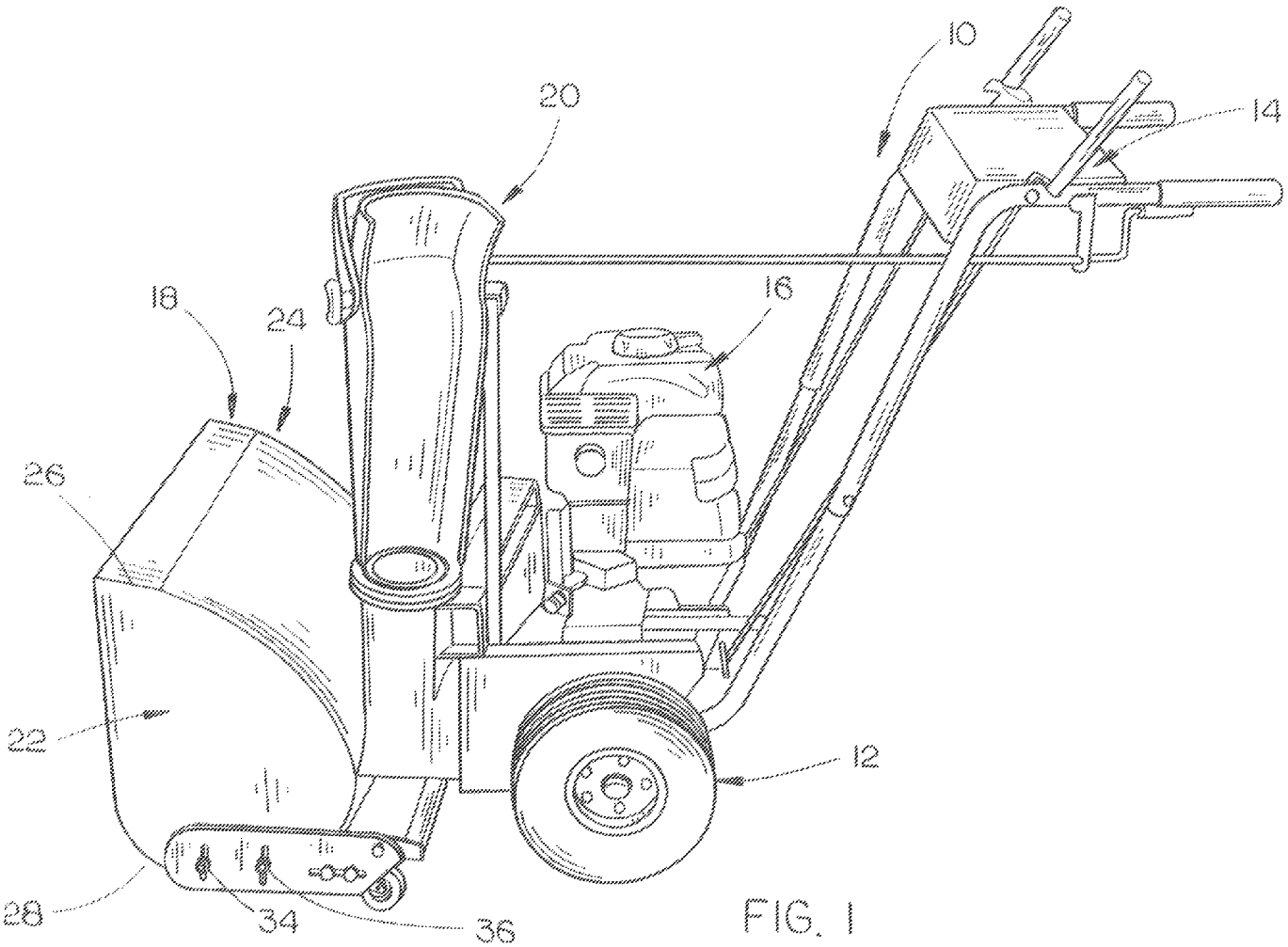
FIG. 1 is a perspective view of a snowblower having the caster wheel assembly of this invention mounted thereon.
Figure 2:
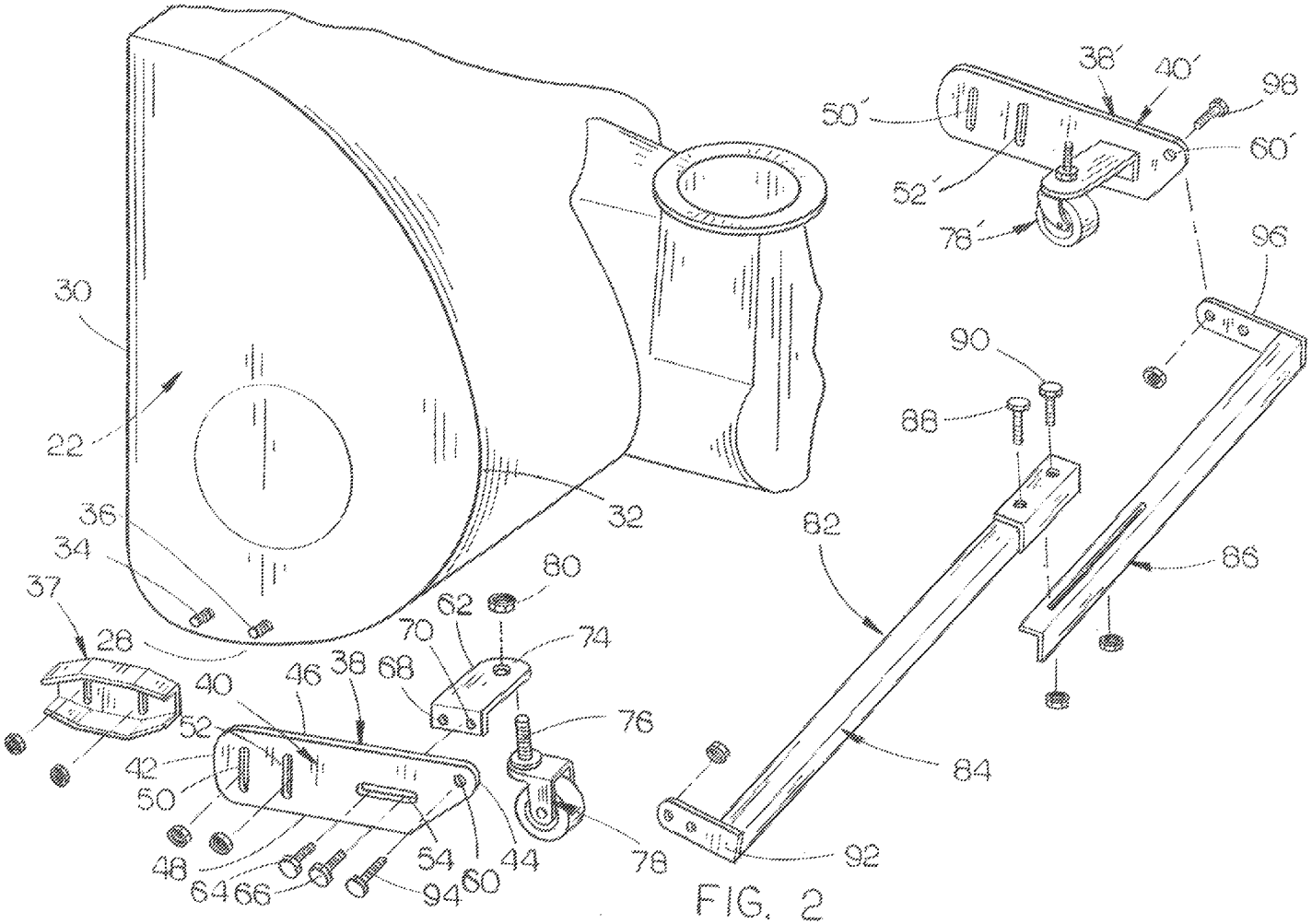
FIG. 2 is an exploded perspective view illustrating the caster wheel assembly of this invention, together with their relationship with respect to the auger housing of a snowblower.

In FIGS. 1 and 2, the numeral 10 refers to generally to a snowblower of conventional design which includes a wheeled frame means 12, handle assembly 14, engine 16, auger housing 18 and discharge chute 20.

Auger housing 18 includes an open forward end into which the snow is passed and a first side wall 22 and a second side wall 24. For purposes of description, side wall 22 will be described as having an upper end 26, lower end 28, a forward end 30 and a rearward end 32. Normally, side wall 22 has a pair of bolts 34 and 36 extending outwardly therefrom to which is normally attached a conventional skid shoe 37. The structure of side wall 24 is identical to that of side wall 22 and will not be described.

The caster wheel assembly of this invention comprises two caster wheel assemblies which are identified by the reference numerals 38 and 38'. Caster wheel assembly 38 includes a vertically disposed support or plate 40, having a forward end 42, rearward end 44, an upper end 46 and a lower end 48. A pair of vertically disposed slots 50 and 52 are formed in the forward end of support 40 as seen in FIG. 2. A horizontally disposed slot 54 is formed in support 40 adjacent the rearward end thereof. An opening 60 is formed in the upper rearward end of support 40, as seen in FIG. 2.

A bracket 62 is selectively horizontally adjustably secured to the support 40 by a pair of bolts 64 and 66 extending through slot 54 and extending through the openings 68 and 70 in bracket 62. Bracket 62 has an opening 74 formed therein which receives the spindle 76 of a caster wheel 78. Spindle 76 is maintained in opening 74 by nut 80.

The caster wheel assembly 38' is identical to the caster wheel assembly 38 with the parts of caster wheel assembly 38 being identical to the parts of caster wheel assembly 38'. The caster wheel assembly 38' includes slots 50', 52' and a slot corresponding to slot 54. The caster wheel 78' is secured to the support 40' in the same fashion as caster wheel 78 is secured to bracket 62.

The numeral 82 refers to a stabilizer bar assembly including stabilizer bars 84 and 86 which are selectively longitudinally secured together by means of bolts 88 and 90. Stabilizer bar 84 has a bracket 92 secured to one end thereof which is secured to the upper rearward end of support 40 by means of bolt 94 extending through opening 60 in support 40 and through one of the openings in bracket 92. Bracket 96 extends from the end of stabilizer bar 86 and is secured to the upper rearward end of support 40' by means of the bolt 98 extending through opening 60' and through one of the openings in bracket 96.

In use, the fact that the caster wheels 78 and 78' are positioned rearwardly of the rearward end of auger housing 18 and inwardly of the side walls thereof ensures that the caster wheel will not protrude outwardly into snow which has not been cleared by the snowblower. The caster wheel assemblies 38 and 38' enable the scraper bar to be selectively adjustably positioned due to the fact that the caster wheels 38 and 38' are selectively vertically adjustably secured to the auger housing 22. The caster wheels 78 and 78' are selectively horizontally adjustably secured to supports 40 and 40' so as to be positioned rearwardly of different styles of auger housings. The longitudinally adjustable connection of the stabilizer bars 84 and 86 enables the stabilizer bars to be used with varying widths of auger housings.

Thus it can be seen that the invention accomplishes all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

We claim:

1. In combination:

a snowblower for removing snow from a surface;

said snowblower including an auger housing having a first upstanding side wall with inner and outer sides, a forward and a rearward end, an upper end and a lower end, a second side wall with inner and outer sides, a forward end and a rearward end, an upper end and a lower end, and a scraper blade extending between said first and second side walls at the lower forward ends thereof;

said first side wall of said auger housing having first and second horizontally spaced-apart and horizontally disposed bolts extending outwardly therefrom;

said second side wall of said auger housing having third and fourth horizontally spaced-apart and horizontally disposed bolts extending outwardly therefrom;

a vertically disposed first support having a forward end, a rearward end, an upper end, a lower end, an inner side and an outer side;

said first support having first and second vertically disposed and horizontally spaced-apart slots formed therein rearwardly of said forward end of said first support;

said first and second bolts being received by said first and second slots of said first support whereby said first support may be selectively vertically adjusted with respect to said auger housing;

nuts mounted on said first and second bolts outwardly of said first support to maintain said first support in position with respect to said auger housing;

said rearward end of said first support being positioned rearwardly of said rearward end of said first side wall;

said first support having a third slot formed therein, which is horizontally disposed, adjacent said rearward end of said first support;

a first caster wheel assembly positioned at said inner side of said first support so as to be positioned rearwardly of said auger housing and inwardly of said first side wall;

said first caster wheel assembly having a pair of spaced-apart and horizontally disposed bolts extending outwardly therefrom which are selectively horizontally adjustably received by said third slot of said first support;

nuts on said pair of bolts which extend from said first caster wheel assembly to maintain said first caster wheel assembly in position with respect to said first support;

said first support being selectively vertically adjusted with respect to said first side wall of said auger housing without causing said first caster wheel assembly to be horizontally adjusted with respect to said auger housing;

said first caster wheel assembly being selectively horizontally adjusted with respect to said auger housing without causing said first support to be vertically adjusted with respect to said auger housing;

a vertically disposed second support having a forward end, a rearward end, an upper end, a lower end, an inner side and an outer side;

said second support having first and second vertically disposed and horizontally spaced-apart slots formed therein rearwardly of said forward end of said second support;

said third and fourth bolts being received by said first and second slots of said second support whereby said second support may be selectively vertically adjusted with respect to said auger housing;

nuts mounted on said third and fourth bolts outwardly of said second support to maintain said second support in position with respect to said auger housing;

said rearward end of said second support being positioned rearwardly of said rearward end of said second side wall;

said second support having a third slot formed therein, which is horizontally disposed, adjacent said rearward end of said second support;

a second caster wheel assembly positioned at said inner side of said second support so as to be positioned rearwardly of said auger housing and inwardly of said second side wall;

said second caster wheel assembly having a pair of horizontally spaced-apart and horizontally disposed bolts extending outwardly therefrom which are selectively horizontally adjustably received by said third slot of said second support;

nuts on said pair of bolts which extend from said second caster wheel assembly to maintain said second caster wheel assembly in position with respect to said second support;

said second support being selectively vertically adjusted with respect to said second side wall of said auger housing without causing said caster wheel assembly to be horizontally adjusted with respect to said auger housing;

said second caster wheel assembly being selectively horizontally adjusted with respect to said auger housing without causing said second support to be vertically adjusted with respect to said auger housing.

2. The combination of claim 1 wherein an elongated stabilizing member, having first and second ends, is secured to said rearward ends of said first and second supports and extends therebetween.

3. The combination of claim 2 wherein said stabilizing member is selectively longitudinally adjustable.

* * * * *